US006347485B1

(12) United States Patent
Hebda

(10) Patent No.: US 6,347,485 B1
(45) **Date of Patent: *Feb. 19, 2002**

(54) POWER ASSIST FOR MOVING A DOOR BETWEEN A CLOSED AND AN AJAR POSITION

(76) Inventor: Thomas J. Hebda, 539 S. Park Rd., Lombard, IL (US) 60148

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/362,248

(22) Filed: Jul. 28, 1999

(51) Int. Cl.[7] ..... E05F 15/12

(52) U.S. Cl. ..... 49/276; 49/139; 49/358; 292/341.16; 292/DIG. 72

(58) Field of Search ..... 49/276, 139, 339, 49/340, 32, 358; 292/DIG. 72, 1, 341.17, 341.16

(56) References Cited

U.S. PATENT DOCUMENTS

| | | | | | |
|---|---|---|---|---|---|
| 2,190,653 | A | * | 2/1940 | Dunn | 49/32 |
| 2,601,983 | A | * | 7/1952 | Schoelkopf | 49/276 |
| 2,746,782 | A | * | 5/1956 | Schamotta | 292/92 |
| 3,425,161 | A | * | 2/1969 | Catlett et al. | 49/253 |
| 4,011,688 | A | * | 3/1977 | Geiss | 49/139 |
| 4,348,835 | A | * | 9/1982 | Jones et al. | 49/139 |
| 4,660,324 | A | * | 4/1987 | Nyenbrink | 49/340 |
| 5,018,304 | A | * | 5/1991 | Longoria | 360/106 |
| 5,375,374 | A | * | 12/1994 | Rohroff | 49/340 |
| 5,392,562 | A | * | 2/1995 | Carambula | 49/346 |
| 5,515,649 | A | * | 5/1996 | Strab | 49/280 |
| 5,623,783 | A | * | 4/1997 | Kenkel | 49/501 X |
| 5,632,515 | A | * | 5/1997 | Dowling | 292/216 |
| 5,765,884 | A | * | 6/1998 | Armbruster | 292/216 |
| 5,878,530 | A | * | 3/1999 | Eccleston et al. | 49/139 |
| 5,910,075 | A | * | 6/1999 | Arnell et al. | 49/25 |

FOREIGN PATENT DOCUMENTS

| | | | | |
|---|---|---|---|---|
| NO | 47933 | * | 11/1928 | 49/276 |

* cited by examiner

*Primary Examiner*—Gregory J. Strimbu
(74) *Attorney, Agent, or Firm*—Robert L. Marsh

(57) ABSTRACT

An assist for use with a motorized door operating device to assist in the opening of a door during its movement from the closed position to an ajar position, and to assist in the closing of the door during its movement from the ajar position to the closed position. The device includes a connector mounted on one of the door and the wall and a motorized catch on the other of the door and wall for engaging and releasing the connector. During a door closing cycle, the assist remains inactive until the catch engages the connector, after which the motorized catch is moved in a first direction to move the door from the ajar position to the closed position. Upon the commencement of a door opening cycle, and upon completion of any unlatching cycle whereby any door latch retaining the door is released, the catch is moved in a second direction for moving the door from the closed position to the ajar position. Once the door is in the ajar position, the catch is disengaged from the connector and the door is allowed to move through the remainder of the door opening cycle without interference from the assist.

4 Claims, 4 Drawing Sheets

POWER ASSIST FOR MOVING A DOOR BETWEEN A CLOSED AND AN AJAR POSITION

The present invention relates to door opening devices and, in particular, to a device to be used in conjunction with a door opener to overcome the resistance occurring when a door is moved between the closed position and the ajar position.

BACKGROUND OF THE INVENTION

In my prior U.S. Pat. No. 5,634,296 I disclosed a device which can be connected between a door and a wall for opening and closing the door against an opening in the wall. Although this device will reliably move a door between and open position and a closed position, the device does not satisfactorily solve two problems which may occur when the device is attached to a typical door. First, where the door has a latch assembly, including a rotatable doorknob, the door must also be fitted with some form of latch release. The most commonly known latch release is the type found in apartment buildings which permits the occupants of apartments to electronically release a latched door by releasing the latch plate in the wall.

Another problem not adequately solved by the door opener in my prior U.S. Pat. No. 5,634,296 is the resistance incurred in moving a door between an ajar position and a closed position. When a door is moved between an ajar position to a fully open position, a door opening device such as disclosed in my prior patent need only overcome the resistance provided by the hinges retaining the door to the wall, and the resistance of the air disturbed by the movement of the door. The closing of a door from an open position to an ajar position also requires relatively little force. A much greater force may be required, however, to move the door between an ajar position and a closed position. An outer door, for example, has seals to prevent the leakage of air into or out of the enclosed premises and the seals cause added resistance during only the portion of the swing of the door between the ajar position and the closed position. The closing of a door against a door latch will also cause greater resistance in this small portion of the swing of the door.

A door controlling device in accordance with my prior patent could be fitted with a motor and a linkage sufficiently powerful to overcome all the forces incurred to fully open or fully close a door, but such a device would encounter another problem. The door controller of my prior patent includes an obstruction sensing device for terminating the operation thereof when the door encounters an object such as a chair or a person's hand. When the door operator is fitted on a door which incurs a great deal of resistance in moving between the ajar and closed positions, the obstruction sensing device must not be so sensitive as to be triggered during this portion of an opening or closing cycle. It would, therefore, be desirable to provide a device which would be used in conjunction with a door opener such as disclosed in my prior U.S. Pat. No. 5,634,296 which would apply additional force at the end of a door closing cycle to move the door between the ajar position and the closed position, and provide additional force at the beginning of the door open cycle to move the door between the door closed position and an ajar position.

SUMMARY OF THE INVENTION

Briefly, the present invention is an assist to be used in conjunction with a motorized door operating device to assist in the opening of a door during its movement from the closed position to an ajar position, and to assist in the closing of the door during its movement from an ajar position to a closed position. The assist includes a connector mounted on one of the door and the wall and a moveable means mounted on the other of the door and wall for engaging and releasing the connector. During a door closing cycle, the assist remains inactive until the moveable means engages the connector, after which the moveable means moves in a first direction relative to the door or the wall to which it is attached. Movement of the moveable means in the first direction will move the door from the ajar position to a closed position. Upon the commencement of a door opening cycle, and upon completion of any unlatching cycle whereby any door latch retaining the door is released, the moveable means is moved in a second direction for moving the door from a closed position to an ajar position. Once the door is in the ajar position, the moveable means is disengaged from the connector and the door is allowed to move through the remainder of the door opening cycle without interference from the device.

In the preferred embodiment the assist includes a first detector for detecting when the moveable means has engaged with the connector during a closing cycle such that the moveable means will not commence its movement until the parts are in engagement. The assist further includes second and third detectors for detecting when the moveable means has reached the end of its travel in either the first direction or the second direction for terminating power to the motor upon completion of a cycle.

For a door which does not require the turning of a knob to release a latch, an opening cycle may be commenced simultaneously with the commencement of a door opening cycle of a door opener such as disclosed in my prior patent. A closing cycle is commenced when the first detector detects that the moveable means has engaged the connector.

BRIEF DESCRIPTION OF THE DRAWINGS

A better understanding of the present invention will be had after a reading of the following detailed description taken in conjunction with the following drawings wherein.

DETAILED DESCRIPTION OF THE PREFERRED EMBODIMENT

Figure 1:
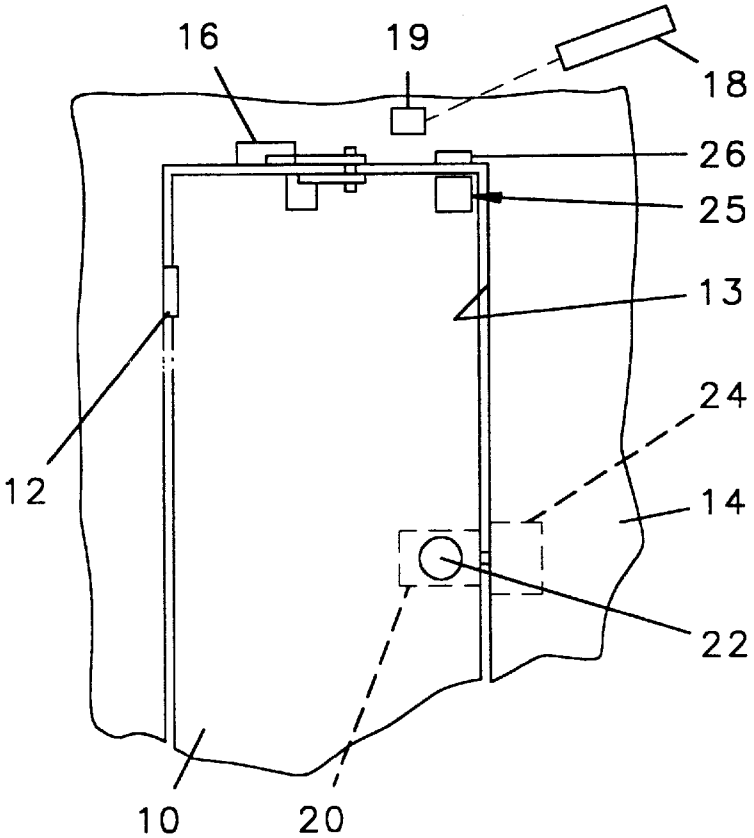
FIG. 1 is a fragmentary front view of a door having an assist assist in accordance with the present invention attached to a door which is in the closed position.

Referring to FIG. 1, a door 10 is pivotal about the about the axis of pins 12 of hinges to open and close the door against a frame which defines an opening 13 in a wall 14. A door operating assist 16 is attached to the upper end of the door 10 and to the wall 14 and is operated by a start button 18, which may be an infrared transmitter, which sends a signal to a receiver 19 connected to the assist 16. The door is retained in a closed position by a latch 20 which can be released by rotating a door knob 22 or by an electrically operated latch release 24.

Figure 4:
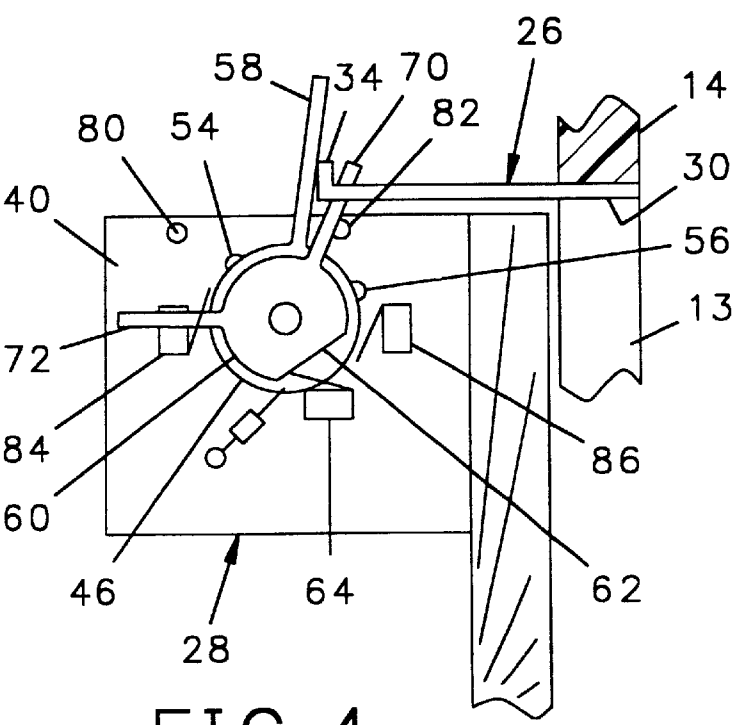
FIG. 4 is a side elevational view of the door and assist shown in FIG. 3.
Figure 6:
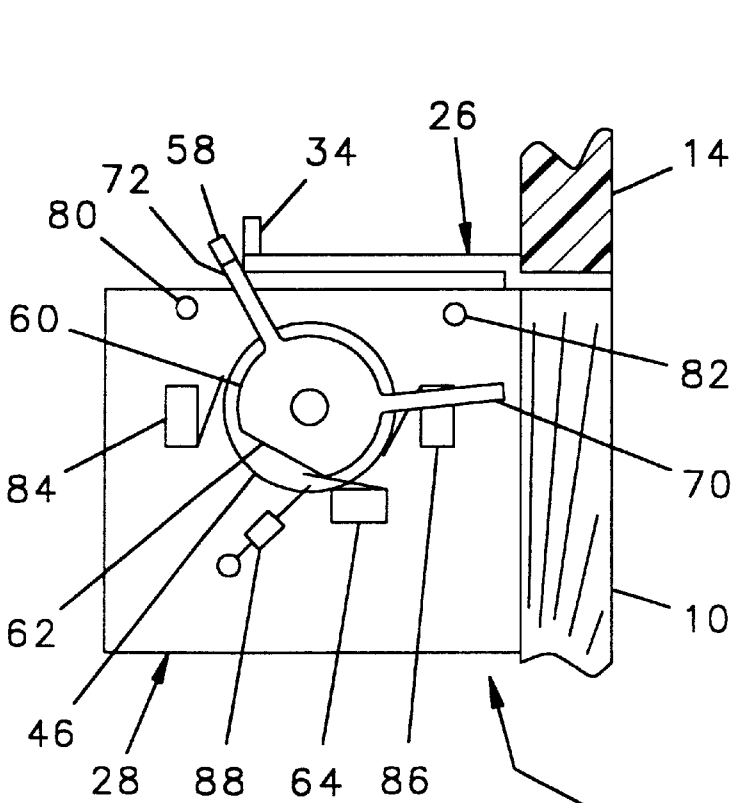
FIG. 6 is a side elevational view of the assist on a door in the closed position.

When the door 10 is closed against the wall 14 and the start button 18 is actuated, the latch release 24 is actuated thereby releasing the latch 20 after which the door operating assist 16 will move through a door opening cycle and cause it to swing away from the wall 14. When the door is open and the start button 18 is again actuated, the door operating assist 16 will move through a closing cycle and push the door into the opening 13 until the latch 20 is engaged.

Where the wall 14 is an outside wall of a structure and the door opening 13 includes seals to seal the interior of the structure against adverse elements, the movement of the door from the closed position as shown in FIG. 6 to the ajar position as shown in FIG. 4 may require a substantially greater force than that required to move the door from the ajar position to the fully open position. Conversely, during a closing cycle the movement of the door from an open position to an ajar position may require only a small fraction of the force required to move the door from an ajar to a fully closed position. The force required to overcome the resistance as the door is moved between the ajar position and the closed position may be overcome by providing a stronger motor and linkage in the door operating assist 16, or it may be overcome by providing an assist 25 in accordance with the present invention.

As shown in FIGS. 1–6, the assist 25 is mounted adjacent to the door opening assist 16 and includes a bracket 26 mounted on the wall 14 and a power operated engagement unit 28 mounted on the door. The bracket 26 has a portion 30 for attachment to a wall and a contact plate 32 extending perpendicular thereto, having an outer end 34 and a central opening 36.

The engagement unit 28 includes a U-shaped mounting plate 37 having spaced apart parallel end portions 38, 39 and a transverse center portion 40. The assist 25 is depicted as being mounted with end portion 39 screwed to the door 10, however, it may be attached to a door opening on the opposite side by mounting end portion 38 to the door 10 instead of end portion 39. Mounted between end portions 38, 39 is a reversible DC motor 41 and gear assembly 42 having an output shaft 44 which extended through an opening, not shown, in the center portion 40.

Figure 7:
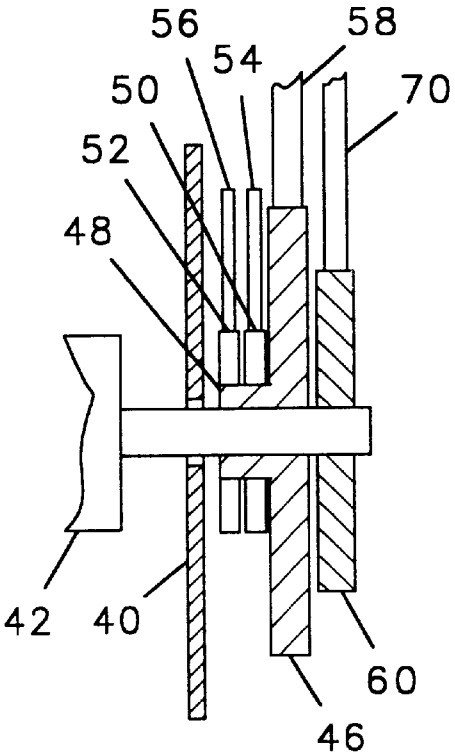
FIG. 7 is a fragmentary enlarged cross sectional view of the assist showing the mounting of the parts on the output shaft thereof.

Referring to FIG. 7, an annular cam retainer 46 is fitted around the shaft 44 the central opening of which is a little larger than the outer diameter of the shaft 44 such that the cam retainer 46 is freely rotatable about the shaft 44. The cam retainer 46 has a cylindrical mounting portion 48 and snuggly fitted around the circumference of the mounting portion 48 are first and second cam members 50, 52. The cam members 50, 52 have annular bodies with protrusions 54, 56 thereon respectively which interact with limit switches as further described below. Extending radially from the body of the annular cam retainer 46 is a detector pin 58 the distal end of which is long enough to contact the outer end 34 of the contact plate 32 for detecting the engagement of the unit 28 with the plate 32 as is also further described below.

Figure 2:
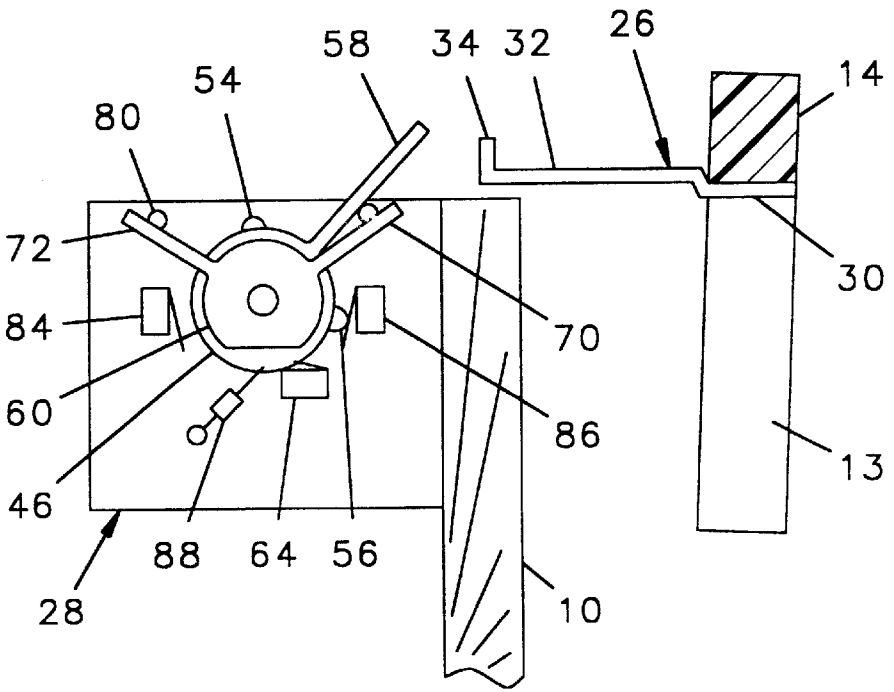
FIG. 2 is a fragmentary side view of a partially opened door in a wall fitted with the assist of FIG. 1.

Axially outward of the cam retainer 46 on the output shaft 44 is a cam 60 which is locked to the shaft 44 for rotation therewith. The cam 60 has a flat 62 thereon which will interact with a limit switch 64 on the center portion 40 of mounting plate 37 when the cam 60 is in the standby position as is shown in FIG. 2. Extending from the outer circumference of the cam 60 are a first drive bar 70 and a second drive bar 72 which are oriented at about 120 degrees apart from one another, are equally angularly spaced from flat 62 as shown and define a plane perpendicular to one of the door or the wall. As described below, drive bar 70 will engage bracket 26 to urge the door 10 from the ajar position to the closed position and drive bar 72 will urge the door 10 from the closed position to the ajar position. When the assist 25 is mounted to a door opening from the other side, and mounting portion 39 is screwed to the door 10, the function of drive bars 70 and 72 will be reversed.

Figure 3:
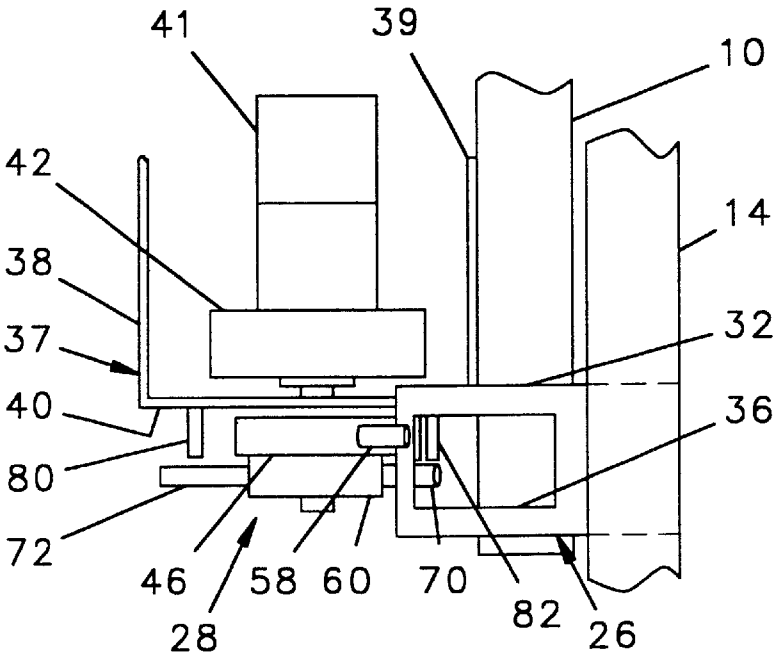
FIG. 3 is a top elevational view of the assist shown in FIG. 1 with the door in an ajar position.
Figure 5:
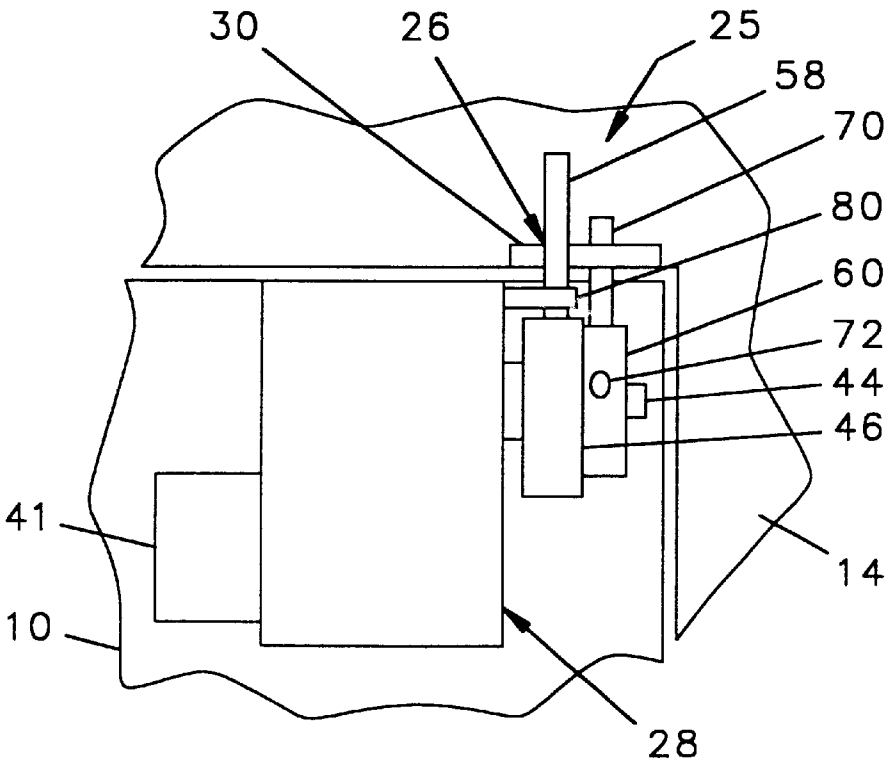
FIG. 5 is a front elevational view of the assist on a door in the ajar position.

As best shown in FIGS. 3, 4, and 5, extending perpendicular to the surface of the central portion 40 of the mounting plate 37 are a pair of limit pins 80, 82 which extend axially parallel to the output shaft 44 sufficiently far to provide a limit to clockwise and counterclockwise rotation of the detector pin 58. Positioned on the center portion 40 of the mounting plate 37, on opposite sides of the output shaft 44 are second and third limit switches 84, 86 respectively which are adapted to be engaged by the protrusions 54, 56 of cam members 50, 52 respectively.

Referring to FIGS. 2, 3, and 4, when the door 10 is moved away from the wall 14 and the engagement unit 28 is disengaged from the bracket 26 as shown in FIG. 2, a spring 88 will urge the cam retainer 46 to rotate clockwise until the detector pin 58 attached thereto rests on the second limit pin 82. When the pin 58 contacts the limit pin 82, the cam retainer 46 will have rotated until the second protrusion 56 on cam 52 has engaged the third limit switch 86. As can be seen, the detector pin 58 is sufficiently long enough for the distal end thereof to contact the outer surface 34 of the contact plate 32 when the door is subsequently moved back into the ajar position shown in FIG. 4, thereby causing counter clockwise rotation of the cam retainer 46 and the cam members 50, 52 and moving protrusion 56 out of contact with the third limit switch 86.

When the door 10 is moved away from the wall 14 as shown in FIG. 2, cam 60 is in the stand by position, and the detector pin 58 is resting on the second limit pin 82. The drive bars 70, 72 have lengths which are equal to each other and are short enough to permit the distal end of the bar 70 to move under the outer end 34 of the contact plate 32 as the door is subsequently moved from the open position as shown in FIG. 2 to the ajar position as shown in FIG. 4. The drive bars 70, 72 are also long enough for the distal end of bar 70 to extend through the opening 36 in the contact plate 32 and contact the inner surface of the outer end 34 when cam 60 is rotated counterclockwise to move the door 10 to the closed position shown in FIG. 6.

Figure 8:
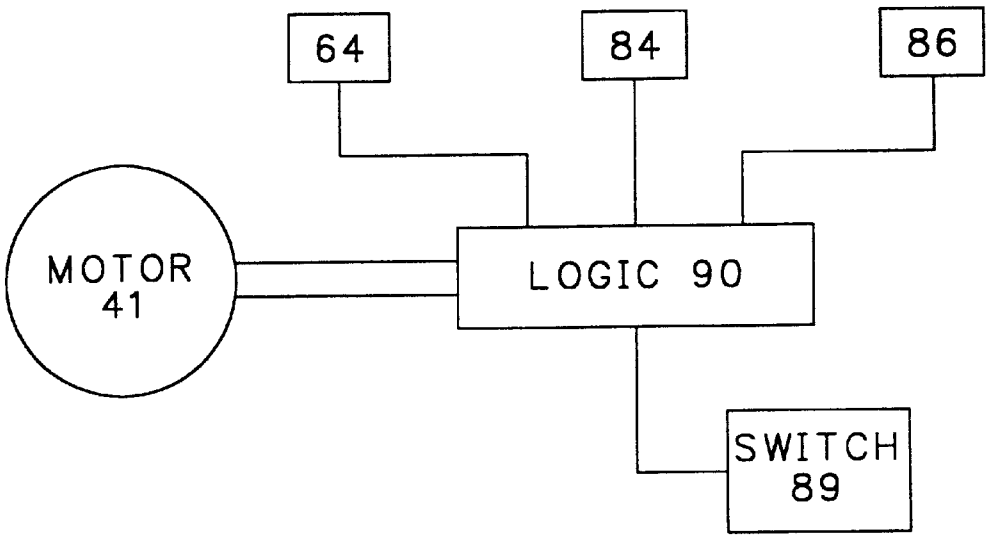
FIG. 8 is a block diagram of the circuit for the assist shown in FIG. 1.

Referring to FIG. 8, the assist 25 further includes a first start switch 89 for initiating a cycle for moving the door from a closed position to an ajar position. The start switch 89 may be actuated simultaneously with the actuation of a door opening cycle for the door operating assist 16, or may be sequenced to commence after completion of a release cycle from a latch release 24. Where the assist 25 is to be initiated simultaneously with the door operating assist 16, the start button 18 which commences an opening cycle for the door operator 16 may also serve as the first start switch 89. On the other hand, where a latch release 24 is also employed, the first start switch 89 may be actuated electronically after the latch release 24 is activated.

The assist 25 further includes a logic 90, which may be in the form of a microprocessor that is responsive to the start switch 89, the first limit switch 64, the second limit switch 84, and the third limit switch 86, and which directs power to the motor 41 to rotate the output shaft 44 in either a clockwise or a counter clockwise direction.

To move a door from the closed position as shown in FIG. 6 to an ajar position as shown in FIG. 4, the first switch 89 is actuated either by depressing a button 18 or by the actuation of a latch release 24. Upon detecting the actuation of the start switch 89, the logic 90 directs power to the motor 41 to rotate the drive shaft 44 in a clockwise direction. The cam 60 rotates with the output shaft 44, until the second drive bar 72 contacts the outer end 34 of the bracket 26. Continued clockwise rotation of the shaft 44 will cause the second drive bar 72 to push against the outer end 34 of the contact plate 32 and thereby push the door 10 out of the opening 13 and into the ajar position.

As the door moves toward the ajar position, the spring 88 will rotate cam retainer 46 clockwise thereby maintaining the distal end of pin 58 against contact plate 32. The second cam member 52 will rotate with the cam retainer 46 causing protrusion 56 to engage the third limit switch 86. When the logic 90 detects that the third limit switch 86 has been actuated, it will reverse the power to the motor 41, thereby causing output shaft 44 to commence rotating in a counter clockwise direction. The cam 60 will rotate counter clockwise with the shaft 44 until the first limit switch 64 engages the flat 62, and on the actuation of switch 64 the logic 90 will terminate power to the motor 41 thereby returning the cam 60 to the standby position as shown in FIG. 2. The assist will then remain inactive until it is again actuated by the door being moved from an open position into an ajar position.

When the door is closed by the door operator 16, the engagement unit 28 will again engage the bracket 26 and the distal end of the detector pin 58 will encounter the outer end 34 of the contact plate 32 just before the door reaches the ajar position. As the door continues to close, movement of the door into the ajar position will cause the detector pin 58 and cam holder 46 to be rotated counterclockwise about the shaft 44 and cause the protrusion 56 of the second cam member 52 to move away from the third limit switch 86 thereby deactivating the switch 86. When the logic 90 detects that the third limit switch 86 has become deactivated, it will apply DC power to the motor 41 for rotation of the shaft 44 and the cam 60 and drive bars 70, 72 in a counter clockwise direction. As the drive bar 70 rotates in a counter clockwise direction the distal end thereof will extend through the central opening 36 and engage the inner portion of the outer end 34 of the contact plate 32 and pull the distal end of the door 10 into opening 13 until the door is moved to the closed position shown in FIG. 6. After the output shaft 44 and the cam 60 have rotated enough to move the door into the closed position, the first protrusion 54 of first cam member 50 will engage the second limit switch 84, and in response thereto, the logic 90 will reverse the polarity of power to the motor 41 and thereby causing it to commence rotating in a clockwise direction. The motor 41, the output shaft 44, the cam 60, and drive bars 70, 72 will rotate in the clockwise direction until the flat 62 is engaged by the first limit switch 64, and in response to which the logic 90 will terminate power to the motor 41. The assist shall then be again returned to the standby position and be ready for further actuation.

As can be seen, the pin 58 and the drive bars 70, 72 will not interfere with the movement of the door 10 when the assist is not in use. The door may be manually opened and closed and the engagement of the pin 58 with the outer end 34 of the bracket 26 will not inhibit the manual opening and closing of the door.

To operate properly, switch 84 must be actuated by protrusion 54 immediately after the door 10 is moved from the ajar position and into the closed position. Similarly, switch 86 must be actuated immediately after the door 10 is moved from the closed position into the ajar position. The timing of the actuations of these two switches are adjusted by rotating the cam members 50, 52 about the cam retainer 46.

To modify the assist 25 for attachment to a door opening in the other side, the spring 88 is repositioned to urge the cam retainer to rotate counter clockwise rather than clockwise as shown. Also, the logic 90 is modified to switch the rolls of switches 84 and 86.

While the present invention has been disclosed with respect to a single embodiment, it will be appreciated that many variations and modifications may be made without departing from the true spirit and scope of the invention. It is, therefore, the intent of the appendent claims to cover all variations and modifications that fall within the true spirit and scope of the invention.

What is claimed:

1. An assist for moving a door mounted to a wall between an ajar position and a closed position, said assist comprising;

a connector attachable to one of the door and the wall, an engagement unit having an attachment member for attachment to the other of the door and the wall, said engagement unit comprising a first movable means and a second movable means, said first movable means and said second movable means movable a plane perpendicular to a plane defined by the other of the door and the wall and being spaced apart from one another by an angle of approximately 120 degrees, said first movable means rotatable in said perpendicular plane for moving the door from the ajar position to the closed position and said second movable means rotatable in said perpendicular plane for moving the door from the closed position to the ajar position.

2. An assist in accordance with claim 1, wherein said first and second movable means are rotatable about an axis parallel to said plane defined by the other of the door and the wall.

3. An assist in accordance with claim 1 and further comprising a detector for detecting when the door is in the ajar position, a motor for driving said first and second movable means, and means connected to said detector for initiating movement of said first movable means in response to a signal from said detector.

4. An assist in accordance with claim 1 and further comprising;

a first means for determining when the door is in the ajar position, a second means for determining when the door is in the closed position, a start means for starting the assist when the door is in the closed position, a reversible motor drivingly connected to the first and second movable means, and a third means for directing said motor to rotate said first movable means in a first direction in response to said first means after the door has moved from an open position to the ajar position and to rotate said second movable means in a second direction in response to a signal from said start means to move the door from the closed position to the ajar position.

* * * * *